United States Patent [19]

Akio

[11] Patent Number: 4,755,636

[45] Date of Patent: Jul. 5, 1988

[54] PISTON POSITION DETECTING DEVICE FOR FLUID PRESSURE CYLINDER

[75] Inventor: Nakata Akio, Chiba, Japan

[73] Assignee: Taiyo, Ltd., Osaka, Japan

[21] Appl. No.: 66,055

[22] Filed: Jun. 24, 1987

[51] Int. Cl.[4] ..... H01H 35/38

[52] U.S. Cl. ..... 200/82 E; 73/745

[58] Field of Search ..... 307/118; 340/626; 73/717, 723, 744, 745 X; 91/1; 92/5 R; 335/205, 206, 207

[56] References Cited

U.S. PATENT DOCUMENTS 3,450,853 6/1969 Snyder ..... 200/81.9 M
3,507,359 4/1970 Warmock ..... 200/81.9 M
4,176,264 11/1979 Tann ..... 200/82 E
4,608,870 9/1986 Huber ..... 200/82 E

*Primary Examiner*—G. P. Tolin
*Attorney, Agent, or Firm*—Koda and Androlia

[57] ABSTRACT

A piston position detecting device including a cylinder tube, a cap cover and a head cover closing both ends of the cylinder tube, a piston slidably provided within the cylinder tube, a piston rod connected to the piston on its axis and passing through the head cover, a ring-shaped permanent magnet provided on one end of the piston and at least one reed switch provided in at least one cover and extending into the interior of the cylinder tube with the reed switch being displaced axially from the center of the piston and provided transversely to the axis of the piston.

3 Claims, 3 Drawing Sheets

PISTON POSITION DETECTING DEVICE FOR FLUID PRESSURE CYLINDER

BACKGROUND OF THE INVENTION

The present invention relates to an improved piston position detecting device for detecting with a reed switch the position of a piston in a fluid pressure cylinder such as a pneumatic cylinder, a hydraulic cylinder, or the like.

It is known in the prior art to provide such a type of the piston position detecting device which has a reed switch disposed on the outer side of a fluid pressure cylinder and, in addition, includes a permanent magnet mounted to a piston so that the reed switch can be turned on by the magnetic action of the permanent magnet when the piston reaches a specific position.

However, one of the disadvantages is such that the reed switch, which is disposed exteriorly on the fluid pressure cylinder, will operate needlessly upon being exposed with the entire fluid pressure cylinder in a powerful magnetic field, for instance, caused by the secondary current of 7,000 to 15,000A in an electric welder.

To avoid the incident, a construction of the device shown in FIGS. 4 and 5 has been proposed. According to the construction, a fluid pressure cylinder 1 comprises a cylinder tube 2 closed at both ends with a cap cover 3 and a head cover 4 respectively, and a piston 5 slidably mounted within the cylinder tube 2. The cap cover 3, which is formed of a magnetic material in order to magnetically shield its hollow space 6 from the outside, has a box-shaped position detector body 7 disposed in the upper center thereof. The position detector body 7 contains a surge-voltage reducing resistor 8, a varister 9, and a motion indicating lamp 10, all of which are mounted to a circuit board 11 of which circuitry is connected with insulated wires 12 for external connection. A cylindrical non-magnetic casing 13, as protruding from the position detector body 7, extends inwardly through an opening 14 formed in the cap cover 3 thus to be placed in the hollow space 6. The casing 13 contains a reed switch 15 which is arranged on the axis 0 of the fluid pressure cylinder 1 while being held within the casing 13.

Additionally, in the center of the rear side (cap side) of the piston 5 is disposed a magnet 17 held by a non-magnetic holder 16.

Accordingly, when the magnet 17 becomes opposite to the reed switch 15 as the piston 5 travels backward to a specific position (generally, the end of stroke on the cap side), the reed switch 15 will be turned on thus for detecting that the piston 5 reaches the determined position.

According to the construction, because the reed switch 15 in the casing 13 is opposite to the magnet 17 on the axis 0, the position of the piston 5 cannot be detected at the side of the head cover 4 since a piston rod 18 extends outwardly therethrough making it impossible to mount the reed switch 15 on the cap cover 4. Particularly, the position of the piston 5 can be detected at the backward end of the stroke.

SUMMARY OF THE INVENTION

It is an object of the present invention to enable an additional reed switch to be mounted to the head cover thus to detect the position of a piton on the head cover side as well as the cap cover side.

BRIEF DESCRIPTION OF THE DRAWING

Other objects and features of the present invention will be apparent from the description which proceeds with reference to the accompanying drawings.

DETAILED DESCRIPTION OF THE INVENTION

Figure 1:
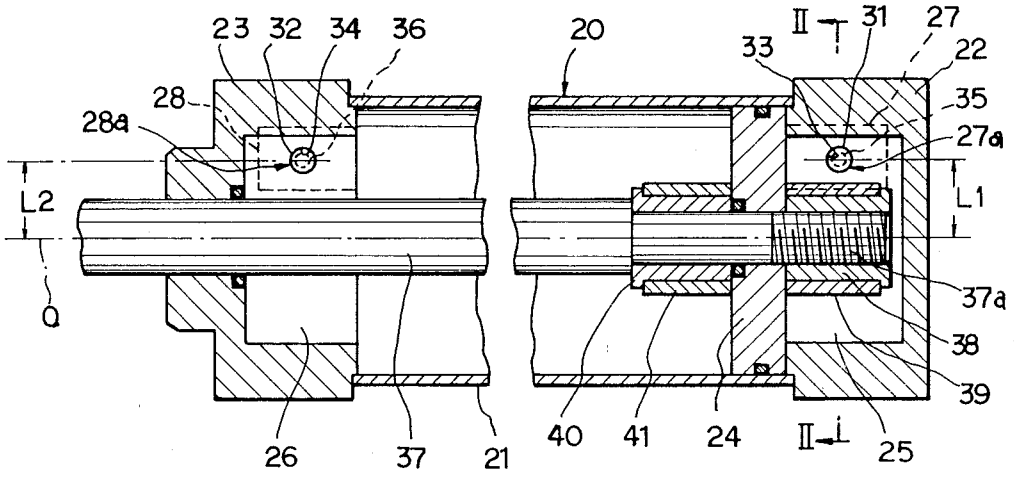
FIG. 1 is a cross-sectional view of a device of the present invention.
Figure 2:
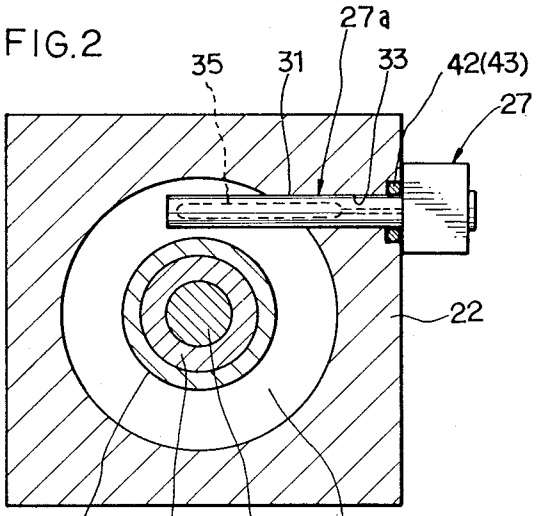
FIG. 2 is an enlarged cross-section view taken on the line II—II of FIG. 1.
Figure 3:
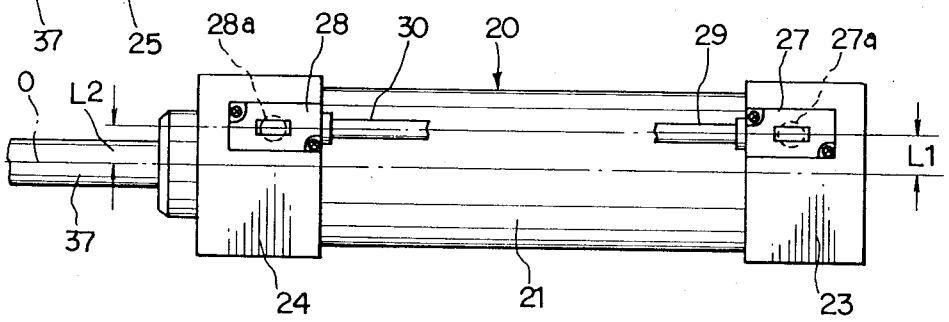
FIG. 3 is an external view of a device of the present invention.

As shown in FIGS. 1 and 2, a fluid pressure cylinder 20 comprises a cylinder tube 21 closed at both ends with a cap cover 22 and a head cover 23 respectively, and a piston 24 slidably mounted within the cylinder tube 21. Both the cap cover 22 and head cover 23 are formed of magnetic material such as iron or the like in order to magnetically shield their respective hollow spaces 25 and 26 from the outside.

Figure 4:
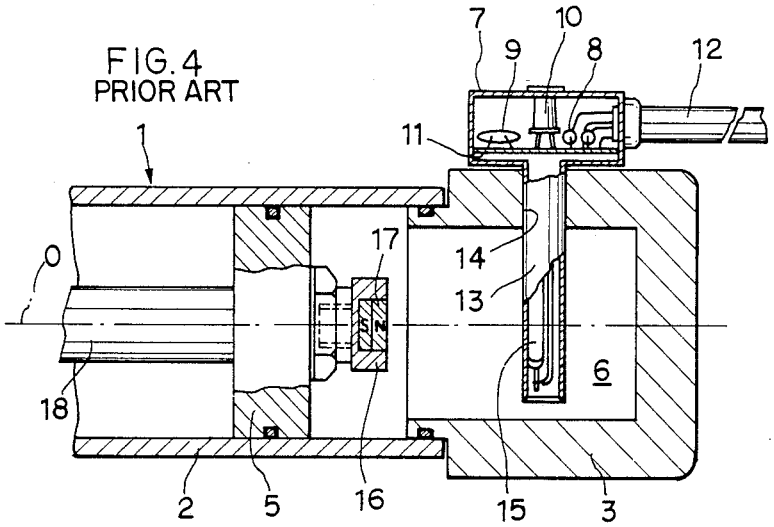
FIG. 4 PRIOR ART
FIG. 4 is a partially cross-sectional view of a prior art device.
Figure 5:
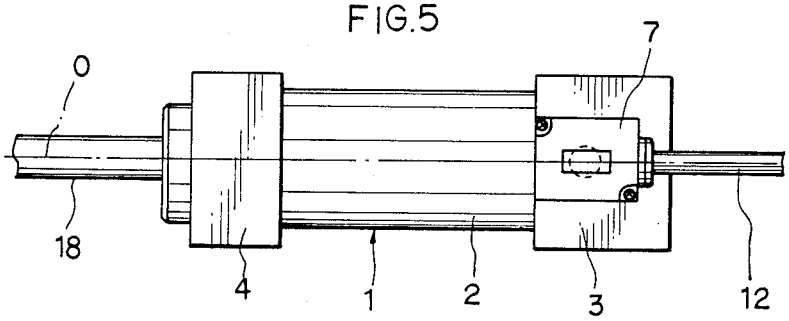
FIG. 5 is an external view of a prior art device.

Each of the cap and head covers 22, 23 has a box-shaped position detector body 27 or 28 mounted to an external side thereof in the off-center position. The position detector bodies 27 and 28, each of which contains a resistor, a varister, and a motion indicating lamp similarly as shown in FIGS. 4 and 5, have their respective insulated wires 29 and 30 extending outwardly.

The position detector bodies 27 and 28 have their respective detecting sections **27*a* and 28*a*, each of which comprises a cylindrical non-magnetic casing 31 or 32 and a reed switch 35 or 36 mounted within the casing 31 or 32 while protruding from the body. The casing 31 and 32 are arranged through openings 33 and 34 formed respectively in the cap cover 22 and the head cover 23 so as to extend across and off the axis 0 of the fluid pressure cylinder 20. More specifically, the casing 31 is kept at a distance L1 from the axis 0 in the hollow space 25 of the cap cover 22 while the casing 32 is kept at a distance L2 from the axis 0 in the hollow space 26 of the head cover 23. The distances L1 and L2 can be equal. Sealing packings 42 and 43 are mounted respectively between the casings 31, 32 and the cap and hear covers 22, 23**.

An annular magnet 39 is mounted in the periphery of a cushion nut 38 screwed onto a threaded end portion **37*a* of a piston rod 37 while, on the opposite side of the piston 24, an annular magnet 41 is mounted in the periphery of a cushion ring 40 secured round the piston rod 37**.

Accordingly, when the magnet 39 becomes opposite to the casing 31 (along a line crossing the axis 0 at a right angle) as the piston 24 travels rightward, as shown in FIG. 1, with the cushion nut 38 advancing into the hollow space 25 of the cap cover 22, the reed switch 35 in the casing 31 will be activated by a magnetic action of the magnet 39, thus detecting that the piston 24 reaches the end of stroke at the cap side. Meanwhile, when the magnet 41 becomes opposite to the casing 32 as the piston 24 travels leftward with the cushion ring 40 advancing into the hollow space 26 of the head cover 23, the reed switch 36 in the casing 32 will be activated, thus detecting that the piston 24 reaches the other end of the stroke at the head side.

More specifically, because the detector sections 27*a* and 28*a*, which comprise respectively the reed switches 35, 36 and the casing 31, 32 containing their respective switches, are arranged at a distance from the axis 0 of the fluid pressure cylinder thus to be mounted to both the cylinder covers, a cap cover 22 and a head cover 23, the position of the piston 24 can be detected at both ends of the stroke of the piston 24. Additionally, the reed switches 35 and 36 are protected from an external magnetic field by the cap cover 22 and the head cover 23 both formed of magnetic material so as to operate without error even if there is a powerful magnetic field provided, for instance by an electric welder, around the fluid pressure cylinder.

The range of an on-off operation of the reed switch 35 or 36 is determined by a length of the magnet 39 or 41. In a fluid pressure cylinder having a cushion, the reed switches 35 and 36 are intended to activate a while before the piston reaches the end of stroke. As the magnets 39 and 41 are ring-like shaped, the rees switches 35 and 36 can be activated without relation to the rotating motions of the piston 24 and the piston rod 37.

While the reed switches 35 and 36 in their respective casings 31 and 32 are arranged above the axis 0 in the embodiment set forth above, it will be understood to place the same to a lower level, to the left, or the the right. The present invention can be employed in the other types of fluid pressure cylinders as well as a fluid pressure cylinder having a cushion.

I claim:

1. A piston position detecting device of a fluid pressure cylinder, comprising:

a cylinder tube;

a cap cover and a head cover made of magnetic material, said cap cover and head cover being coupled to and closing both ends of said cylinder tube;

a piston that slides along an inner circumferential surface of said cylinder tube; and a piston rod that is coupled with said piston on its axis, and that slidably passes through said head cover;

a ring shape permanent magnet mounted on at least one side in an axial direction of said piston;

hollow spaces which allow said magnet to project thereinto formed in said cap cover and head cover; and a detector section comprising a magnetically actuated switch in a cylindrical casing made of non-magnetic material provided in and projecting from an outer circumferential surface of said cap cover or head cover into the hollow space thereof, said detector section is further provided at a position displaced from the axis of said piston by a distance greater than a radium of said ring-shaped permanent magnet and transverse to said axis of said piston.

2. The device as set forth in claim 1, wherein between said detector section and said cap cover or head cover, a packing for sealing is provided.

3. The device as set forth in claim 1, wherein said detector section is provided in said cap cover or head cover, and said permanent magnet is provided on both sides in the axial direction of said piston.

* * * * *

UNITED STATES PATENT AND TRADEMARK OFFICE

CERTIFICATE OF CORRECTION

PATENT NO. : 4,755,636

DATED : July 5, 1988

INVENTOR(S) : Akio Nakata

It is certified that error appears in the above-identified patent and that said Letters Patent is hereby corrected as shown below:

On the title Inventor should read:

--(75) Inventor: Akio Nakata, Chiba Japan --.

Signed and Sealed this

Twenty-fifth Day of April, 1989

*Attest:*

DONALD J. QUIGG

*Attesting Officer*

*Commissioner of Patents and Trademarks*